US005237706A

United States Patent [19]

Nalbandian

[11] Patent Number: 5,237,706

[45] Date of Patent: Aug. 24, 1993

[54] MALE GARMENT WITH SCROTAL POUCH

[76] Inventor: Robert M. Nalbandian, 1 E. River Rd., Apt. 1814, Tucson, Ariz. 85704

[21] Appl. No.: 908,187

[22] Filed: Jul. 1, 1992

[51] Int. Cl.[5] ..... A41B 9/02

[52] U.S. Cl. ..... 2/403; 602/67

[58] Field of Search ..... 2/400, 401, 402, 403; 602/67, 68, 70, 73

[56] References Cited

U.S. PATENT DOCUMENTS

| | | | |
|---|---|---|---|
| 2,534,934 | 12/1950 | Viniegra | 128/132 |
| 2,601,602 | 6/1952 | Firsching | 2/403 |
| 3,314,422 | 4/1967 | Phillips | 128/132 |
| 3,504,671 | 4/1970 | Nelkin | 2/403 |
| 3,517,666 | 6/1970 | Atlee | 2/403 |
| 4,173,976 | 11/1979 | Bloomquist | 2/403 |
| 4,345,337 | 8/1982 | Chung | 2/405 |
| 4,377,008 | 3/1983 | Jung | 2/403 |
| 4,644,945 | 2/1987 | Thorner | 2/403 |
| 4,702,237 | 10/1987 | Ichikawa | 2/403 |
| 4,955,088 | 9/1990 | Terjesen | 2/403 |
| 4,961,419 | 10/1990 | Tribble | 2/403 |
| 5,029,345 | 7/1991 | Angheluta | 2/403 |
| 5,070,869 | 12/1991 | Zhang | 2/403 |
| 5,120,264 | 6/1992 | Van Engel | 2/67 |

*Primary Examiner*—Clifford D. Crowder
*Assistant Examiner*—Diana L. Biefeld
*Attorney, Agent, or Firm*—Rosenbaum & Schwartz

[57] ABSTRACT

The present invention provides a male garment with a scrotal pouch. More specifically, the present invention provides a male garment with a scrotal pouch comprising an anterior panel and a posterior panel with an opening in said posterior panel to enable the continuous anterior displacement of the penis and scrotum in the usual anatomic relationship to one another.

9 Claims, 1 Drawing Sheet

MALE GARMENT WITH SCROTAL POUCH

BACKGROUND OF THE INVENTION

The present invention relates generally to a male garment with a scrotal pouch. More particularly, the present invention relates to a male garment with a scrotal pouch which is designed to displace the male genitalia (penis and scrotum) from the normal position below the trunk of the body anteriorly to a more prominent position. The inventive male garment design can be used for men's underwear, so-called overwear, bathing suits, shorts, and trunks. The pants overlying the anteriorly displaced genitalia will be secondarily apparent as an indistinct but discernible swelling suggestive of and consistent with generous endowment of male genitalia.

Various types of men's undergarments which contain pouches have been designed. U.S. Pat. No. 4,173,976 discloses a men's no-fly undergarment with a suspensory pouch which is designed to provide a comfortable fit and support. U.S. Pat. No. 3,517,666 describes a male undergarment with a detachable pouch constructed of multiple non-absorbent and urine-repellant plies of fibers. U.S. Pat. No. 3,504,671 discloses an athletic supporter having an elastic waist belt, a pouch, two elastic bands attaching the waist belt to the pouch and of the same width as the waist belt, and two leg straps attached from the pouch to the belt. The male undergarments disclosed in these patents fail to displace anteriorly the male genitalia from the usual, normal position below the trunk of the body.

U.S. Pat. No. 5,029,345 describes a men's underwear garment with a codpiece attached to the front panel of the garment which provides a vertical opening through which the male genitalia can pass into the codpiece compartment. U.S. Pat. No. 4,345,337 discloses a men's brief with an opening in the front, a cover piece attached to the front of the briefs and covering the opening, and a band-type ring attached to an upper portion of the opening on which to hang the penis to separate it from the scrotum. Although these patents do describe male undergarments in which the genitalia are separated from the body trunk by providing a codpiece or codpiece like attachment to a front panel which contains an opening through which the male genitalia can pass, the undergarment designs do not provide for the continuous displacement of the genitalia to a more physically and visually prominent anterior position.

The present invention is designed to import both physical and aesthetic improvements to male wearing apparel, namely underwear, bathing suits, shorts, and trunks. It is well known that a man's body heat (98.7°), when in continuous contact with the testicles, can induce injury to the spermatocytes. The present invention provides for an improved mechanism of dissipating the body heat by displacing anteriorly the male genitalia from the usual, normal position below the trunk of the body by use of a pouch which is optionally perforated and constructed from a material which dissipates heat and allows for appropriate and adequate ventilation thereby enhancing heat loss from the testicles. Further, it is quite evident that there exists a rising tide of sublimated, symbolic, and often non-verbal sexual candor between the sexes. This candor is often exemplified in the clothing individuals choose to wear. In response to this, the present invention also provides for the modest, enhanced, socially acceptable implicit display of the male genitalia to a more prominent, visually noticeable position.

SUMMARY OF THE INVENTION

It is an object of the present invention to provide a new and improved male garment. It is also an object of the present invention to provide a new and improved male garment wherein the male genitalia are protected from the potentially injurious body temperature and heat of the body (98.7°) thereby maintaining the viability of the male's sperm. It is a further object of the present invention to provide a male garment or undergarment which achieves and maintains comfortable continuous anterior displacement of the scrotum and penis in the usual anatomic inter-relationship. It is still another object of the present invention to provide a male garment which enhances, to the observer, the contours of the male genitalia and raises them to a more prominent anterior position in a socially acceptable manner.

Accordingly, the inventive male garment consists generally of an elastic waist band with an attached front scrotal pouch, comprising an anterior and posterior panel, and an additional panel or panels which are in continuity with the scrotal pouch and attached to the waist band, thereby making up the remainder of the garment. At a minimum, the remainder of the garment may consist of an intergluteal thong which is in continuity with the scrotal pouch and attached to the waist band. Alternatively, the remainder of the garment may consist of several panels which are sewn together such that their composition is in continuity with the scrotal pouch and the elastic waist band thereby creating shorts or pants which contain the previously described scrotal pouch. Additionally, the anterior panel of the scrotal pouch is made of a material that is elastic and contractile, optionally even perforated, yet capable of adequate ventilation, while the posterior panel of the scrotal pouch, also optionally perforated, contains an opening through which the male genitalia can pass in order to be positioned continuously in between the anterior and posterior panels of the pouch. The posterior panel consists of material of sufficient firmness and tensile strength to position the genitalia anteriorly and continuously without discomfort. In contrast, the anterior panel passively and continuously conforms to the contours of the anteriorly relocated genitalia. Accordingly, the material of the posterior panel has a relatively higher tensile strength than the material of the anterior panel.

The objects and advantages of this invention will appear more fully from the following more detailed description of the preferred embodiments of the invention made in conjunction with the accompanying drawings.

DETAILED DESCRIPTION OF THE PREFERRED EMBODIMENT

Figure 1:
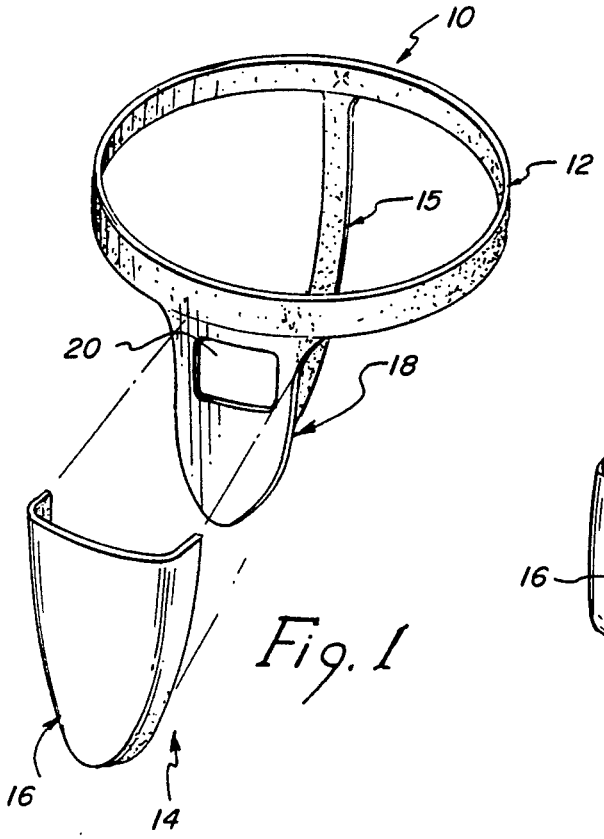
FIG. 1 is a front elevational view of a first preferred embodiment of the inventive male garment with the anterior panel of the scrotal pouch of the inventive garment shown exploded.

FIG. 1 illustrated one preferred embodiment of the male garment 10 of the present invention. Generally, the male garment consists of a waistband 12, a scrotal pouch 14, and an intergluteal panel or thong 15. The waistband 12 is attached to a scrotal pouch 14 which is in continuity with an intergluteal panel or thong 15 which is in turn attached to the waistband 12. The scrotal pouch 14 comprises an anterior panel 16 and a firm, optionally perforated flared posterior panel 18 which contains an opening 20. The anterior panel 16 is sewn to the posterior panel 18 thereby creating a pouch. The male garment is worn by passing the male genitalia through the opening 20 such that they are positioned between the anterior panel 16 and the posterior panel 18 of the scrotal pouch 14. This placement results in the continuous anterior displacement of the scrotum and penis in anatomic relationship with one another while raising them to a more prominent position.

The opening 20 is preferably oval in shape and located near the top of the posterior panel 18 of the scrotal pouch 14. The opening 20 may be of various diameters. The anterior panel 16 is preferably made of compliant material which tends to conform passively to the contours of the anteriorly displaced organs. In addition, the anterior panel 16 is preferably made of a material which is minimally transparent. The posterior panel 18 is preferably made of a material that is soft, yet firmly elastic and contractile with high tensile strength to enable the male organs to be displaced about 1.5 to 4 inches anteriorly from the normal anatomical position. Further, in order to ease the later displacement of the penis for urination, the anterior panel 16 is preferably slightly larger in area than the posterior panel 18 such that the inside of the scrotal pouch 14 encompasses additional area when the anterior panel 16 is sewn to the posterior panel 18. However, the scrotal pouch 14 should just adequately accommodate the volume of the male genitalia in the normal inter-relationship and thereby avoid any compressive distortions of the contours of the genitalia. The function of the scrotal pouch 14 is to restrict random lateral displacement of the genitalia; hence, the anterior panel 16 functions to maintain the normal inter-relationship of the male genitalia and its contours within a restricted pouch volume.

Figure 2:
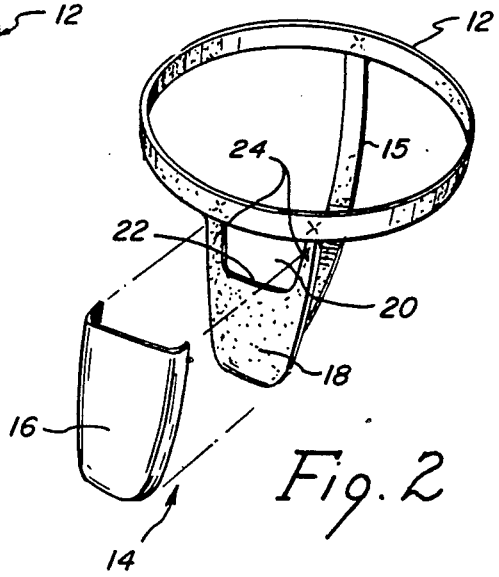
FIG. 2 is a front elevational view of a second preferred embodiment of the inventive male garment with the anterior panel of the scrotal pouch of the inventive garment shown exploded.

FIG. 2 shows another preferred embodiment of the male garment. A waistband 12 is attached to a scrotal pouch 14 which is in continuity with an intergluteal panel or thong 15 which is in turn attached to the waistband 12. The scrotal pouch 14 comprises an anterior panel 16 and a posterior panel 18 which further comprises a generally "U-shaped" border 22 on the top portion of the panel 18. The top edges 24 of the "U-shaped" border 22 are sewn to the waistband 12 thereby creating an opening 20. The anterior panel 16 is sewn to the posterior panel 18 to create the scrotal pouch 14. As in the preferred embodiment illustrated in FIG. 1, the male genitalia pass through the opening 20 so that they are contained within the scrotal pouch 14. The anterior and posterior panels are preferably composed of the same materials previously described with reference to the first preferred embodiment of the male garment illustrated in FIG. 1. Both panels 16 and 18 may be optionally perforated to lower the temperature below 98.7° in the vicinity of the testicles.

Figure 3:
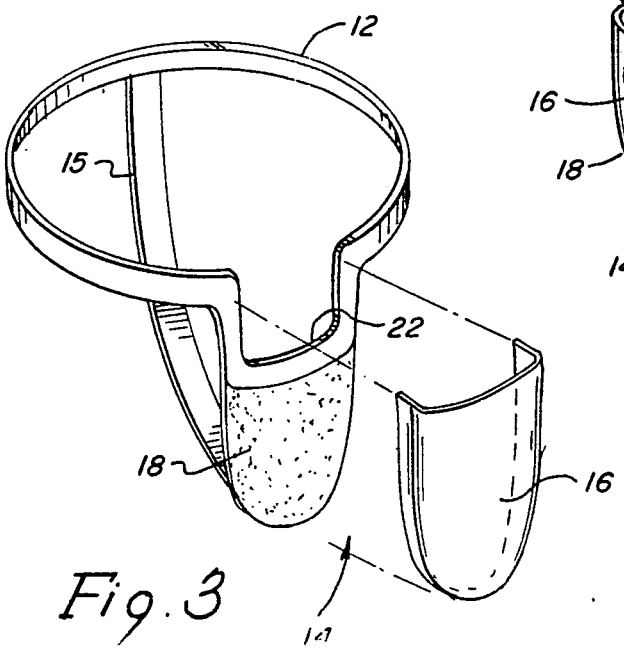
FIG. 3 is a front elevational view of a third preferred embodiment of the inventive male garment with the anterior panel of the scrotal pouch of the inventive garment shown exploded.

A third preferred embodiment of the male garment is illustrated in FIG. 3. In this embodiment, the front portion of a waistband 12, which is defined by that area which the user places on the anterior of the body trunk, forms a "U-shaped" band 22. The waistband 12 is attached to the scrotal pouch 14 which is in continuity with an intergluteal panel or thong 15 which is in turn attached to the waistband 12. The scrotal pouch 14 comprises an anterior panel 16 and a posterior panel 18 which are preferably composed of the materials previously described in relation to the first preferred embodiment of the male garment. Again, panels 16 and 18 may be perforated. This preferred embodiment of the garment is worn by placing the genitalia over the "U-shaped" band 22 and between the anterior and posterior panels 16, 18. The "U-shaped" band 22 eliminates the need for a separate opening (such as the opening 20 in the first and second preferred embodiments of the garment) through which to place the genitalia.

Figure 4:
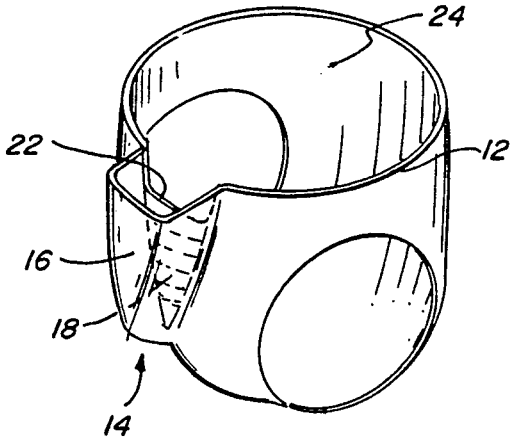
FIG. 4 is a front elevational view of a fourth preferred embodiment of the inventive male garment with the posterior panel of the scrotal pouch of the inventive garment shown in phantom.

FIG. 4 represents a fourth preferred embodiment of the male garment. As in the previously described third preferred embodiment, the front portion of a waistband 12 forms a "U-shaped" band 22. The waistband 12 is attached to the scrotal pouch 14 which is in continuity with a large panel 24 which is also attached to the waistband 12 to form the rest of the garment such that it is equivalent to a men's brief. The large panel 24 may be divided into panels of smaller areas which are sewn together to form the large panel 24. The scrotal pouch 14 comprises an anterior panel 16 and a posterior panel 18 which are preferably composed of the materials previously described. Like the preferred embodiment shown in FIG. 3, the "U-shaped" band 22 eliminates the need for a separate opening for the genitalia. Instead, the genitalia are placed over the "U-shaped" band 22 and into the scrotal pouch 14. This placement results in the continuous anterior displacement of the scrotum and penis in anatomic relationship with one another while raising them to a more prominent position.

The incorporation of the previously described male garment in other types of male wearing apparel such as underwear, bathing suits, shorts, trunks, and (indirectly) pants is clearly contemplated by the invention.

While preferred forms of the invention have been shown in the drawings and described, since additional variations in the preferred forms will be apparent to those skilled in the art, the invention should not be construed as limited to the specific forms shown and described, but instead is as set forth in the following claims.

I claim:

1. A male garment comprising:

a waistband;

a scrotal pouch attached to and depending from an anterior aspect of said waistband, said scrotal pouch comprising an anterior panel and a posterior panel, said posterior panel of said scrotal panel having a genital receiving opening in an upper region thereof which accommodates a male penis and scrotum passing therethrough and into said scrotal pouch whereby a lower edge of said genital receiving opening passes immediately underneath the scrotum and supports the scrotum, and thereby, the testicles and penis, wherein said posterior panel of said scrotal pouch is composed of a first material and said anterior panel of said scrotal pouch is composed of a second material, said first material having a relatively higher tensile strength than said second material such that said first material supports the genitalia in an anteriorly displaced position relative to the body; and leg openings for allowing a wearer's legs to pass through said male garment.

2. The male garment of claim 1, wherein said posterior panel comprises a generally "U-shaped" border at its upper region.

3. A male garment comprising:

a waistband;

a scrotal pouch comprising an anterior panel and a posterior panel, said posterior panel comprising a top edge and a bottom edge, said top edge having a generally "U-shaped" border which is attached to said waistband at the uppermost points of said "U-shaped" border;

at least one panel attached to said waistband and said scrotal pouch, said scrotal pouch being in continuity with said at least one panel; and means for allowing a wearer's legs to pass through said male garment.

4. The male garment of claim 3, wherein said attachment of said waistband to said uppermost points of said "U-shaped" border of said posterior panel forms an opening large enough to accommodate a penis and scrotum to pass through said opening while maintaining their anatomic relationship with one another.

5. The male garment of claim 3, wherein said at least one panel comprises an intergluteal panel which is attached at said waistband opposite from the attachment of said scrotal pouch to said waistband.

6. The male garment of claim 3, wherein said posterior panel is composed of a first material and said anterior panel is composed of a second material, said first material having a relatively greater characteristic of physical support than said second material such that the genitalia are anteriorly displaced from their normal anatomical position.

7. A male garment comprising:

a waistband defined by a front portion which generally forms a "U-shape" against an anterior side of a body trunk and a back portion which encircles the body trunk;

a scrotal pouch attached to and depending form said waistband, comprising an anterior panel and a posterior panel, said posterior panel being shorter in length than said anterior panel and comprising a top edge and a bottom edge, said top edge of said posterior panel being attached to said waistband at the bottom most points of said "U-shape" front portion of said waistband;

at least one panel member attached to said waistband and said scrotal pouch, said scrotal pouch being in continuity with said at least one panel; and means for allowing a wearer's legs to pass through said male garment.

8. The male garment of claim 7, wherein said at least one panel comprises an intergluteal panel.

9. The male garment of claim 7, wherein said posterior panel is composed of firm material with high tensile strength and said anterior panel is composed of compliant material that passively conforms to the genitalia, such that the genitalia are anteriorly continuously displaced 1.5 to 2 inches from their normal anatomical position.

* * * * *